US005595161A

United States Patent [19]

Ott et al.

[11] Patent Number: 5,595,161

[45] Date of Patent: Jan. 21, 1997

[54] DEVICE FOR CONTROLLING THE FUEL INJECTION IN AN INTERNAL COMBUSTION ENGINE

[75] Inventors: Karl Ott, Markgroeningen; Klaus Walter, Bietigheim-Bissingen, both of Germany; Joachim Strate, Seoul, Rep. of Korea

[73] Assignee: Robert Bosch GmbH, Stuttgart, Germany

[21] Appl. No.: 505,275

[22] PCT Filed: Jan. 29, 1994

[86] PCT No.: PCT/DE94/00080

§ 371 Date: Jul. 28, 1995

§ 102(e) Date: Jul. 28, 1995

[87] PCT Pub. No.: WO94/18444

PCT Pub. Date: Aug. 18, 1994

[30] Foreign Application Priority Data

Dec. 2, 1993 [DE] Germany ..... 43 04 163.9

[51] Int. Cl.[6] ..... F02M 51/00

[52] U.S. Cl. ..... 123/491

[58] Field of Search ..... 123/491, 436, 123/179.3, 419, 481; 364/431.07; 73/117.3

[56] References Cited

U.S. PATENT DOCUMENTS

| | | | |
|---|---|---|---|
| 4,873,950 | 10/1989 | Furuyama | 123/179.3 |
| 4,932,379 | 6/1990 | Tang et al. | 123/436 |
| 4,998,552 | 3/1991 | Achleitner | 123/491 |
| 5,345,908 | 9/1994 | Nishimura et al. | 123/491 |
| 5,408,975 | 4/1995 | Blakeslee et al. | 123/491 |

FOREIGN PATENT DOCUMENTS

| | | | |
|---|---|---|---|
| 0017933 | 10/1980 | European Pat. Off. | 123/491 |
| 4230616 | 3/1994 | Germany | 123/491 |

*Primary Examiner*—Raymond A. Nelli
*Attorney, Agent, or Firm*—Michael J. Striker

[57] ABSTRACT

A device for controlling the injection of fuel in an internal combustion engine is described, in which device the position of the crankshaft and camshaft is known in the control device directly after the internal combustion engine is switched on. This is achieved either with the aid of an absolute sensor system or with the aid of a coasting detection in which the angle position of the crankshaft and camshaft is stored in the stationary state. Directly after the internal combustion engine is switched on again, a correctly phased injection into an open inlet valve is carried out. After the start of turning, further injections into one or more open or still closed inlet valves are triggered. After synchronization has taken place, the control device switches over to the normal injection.

8 Claims, 2 Drawing Sheets

DEVICE FOR CONTROLLING THE FUEL INJECTION IN AN INTERNAL COMBUSTION ENGINE

PRIOR ART

The invention is based on a device for controlling the fuel injection in an internal combustion engine of the generic type of the main claim.

In multi-cylinder internal combustion engines with electronic injection, it is usually calculated in the control device when, and how much, fuel is to be injected per cylinder. So that these calculations can be carried out in the correct manner, the respective position of the crankshaft and camshaft of the internal combustion engine must be known; therefore, it is customary, and is described for example in EP-PS 0 017 933, for the crankshaft and the camshaft to be connected to one disk each on whose surface at least one reference mark is provided, a multiplicity of marks of the same kind, also referred to as increment, being additionally provided on the crankshaft disk.

The two rotating disks are sensed by suitable fixed sensors and from the timing sequence of the pulses supplied by the sensors an unambiguous conclusion as to the position of crankshaft and camshaft can be acquired and corresponding drive signals for the injection or ignition can be formed in the control device.

The known system has the disadvantage that an unambiguous position of detection is not possible until after a specific revolution of the two shafts, since the system has to wait for the reference mark or the reference marks to pass the respective sensors for this position detection. Thus, a correct injection cannot take place directly after the start of the internal combustion engine.

Therefore, in the nonprepublished German Patent Application P 42 30 616 which relates to a device for detecting the position of at least one shaft which has a reference mark, it is proposed to use this device in an internal combustion engine and to carry out a coasting detection after the ignition and injection are switched off, the position of the crankshaft and camshaft being detected and stored by the control device when the engine is stationary.

When the engine is switched on again, the position detected in this way is immediately available to the control device so that the first injections can already take place shortly after the start of turning. In the device described in P 42 30 616 it is disclosed that injections are to take place as early as possible, but it is not explained in greater detail how these injections are to be specified precisely.

ADVANTAGES OF THE INVENTION

The device according to the invention with the features of claim 1 has the advantage that the position of the camshaft or crankshaft is known in the control device directly after the internal combustion engine is switched on so that the latter can start with the assignment of the injection to the correct cylinder immediately.

Here, it is particularly advantageous that the first injection can already take place before the start of turning so that the internal combustion engine can run up particularly early.

Furthermore, it is advantageous that after the start of turning, but still before the synchronization, further injections can take place correctly in terms of the cylinders, which injections permit further improvement of the running up.

The transition between the starting injections and the normal injection is advantageously configured in such a way that there is neither an absence of an injection, nor a double injection, in or for one cylinder, as a result of which it is ensured that all the cylinders are supplied with fuel uniformly and that the mixture in individual cylinders is not made leaner or made excessively rich.

DRAWING

The invention is illustrated in the drawing and is explained in greater detail in the description below. Here, FIG. 1 shows a rough overview of the arrangement of the crankshaft and camshaft together with the associated sensors and the control device in which the calculations for controlling the injection take place. In FIG. 2, control signals or signals recorded by sensors are plotted against time during the starting phase of an internal combustion engine.

DESCRIPTION OF THE EXEMPLARY EMBODIMENT

Figure 1:
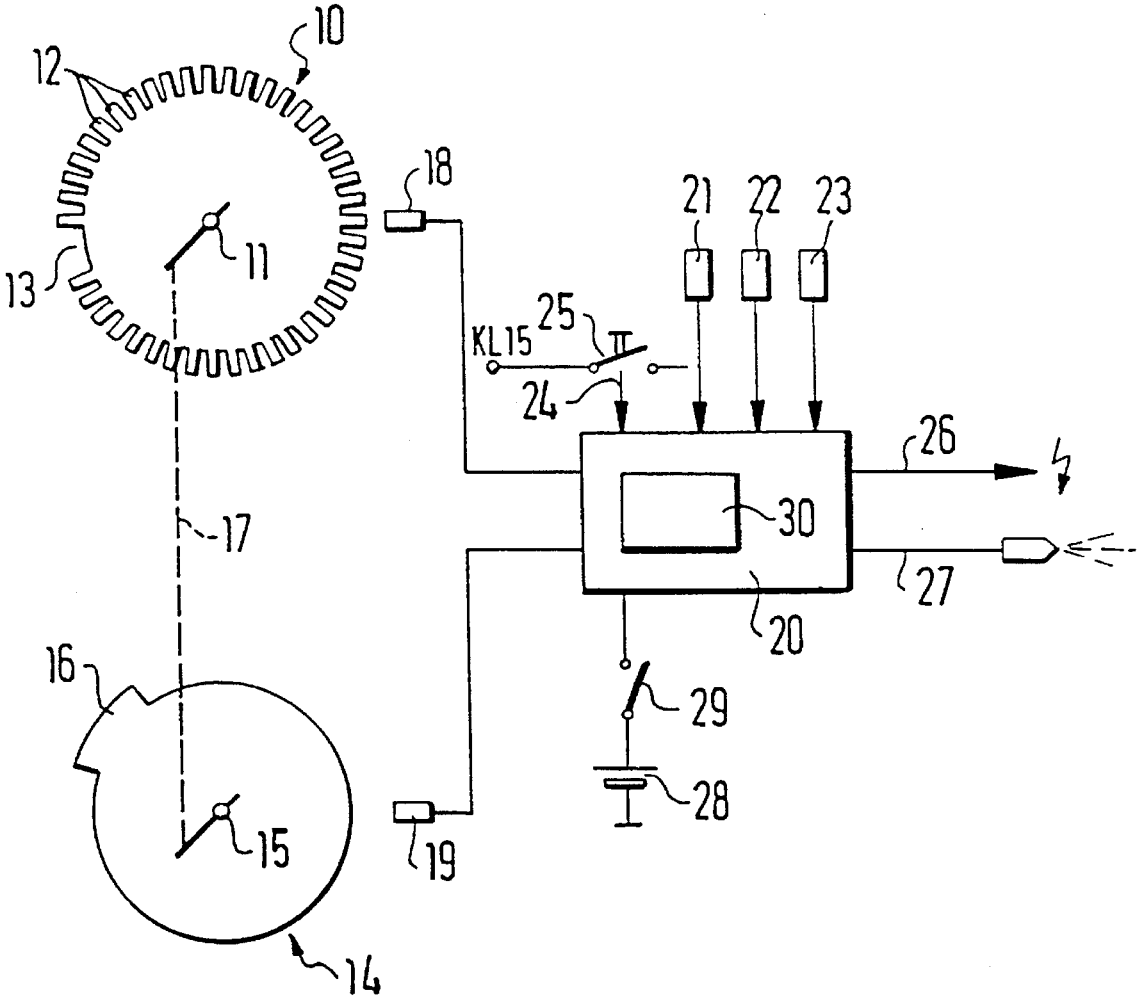

In FIG. 1, components of an internal combustion engine which are required for the explanation of the invention are illustrated by way of example. Here, 10 designates a sensor disk which is rigidly connected to the crankshaft 11 of an internal combustion engine and has a plurality of angle marks 12 of the same kind over its circumference. In addition to these angle marks 12 of the same kind a reference mark 13 is provided which is realized for example by means of two missing angle marks.

A second sensor disk 14 is connected to the camshaft 15 of the internal combustion engine and has on its circumference a segment 16 with which the phase position of the reference mark on the crankshaft disk is determined. 17 symbolizes the connection existing between the crankshaft and camshaft, which connection turns the camshaft at half the speed of revolution of the crankshaft.

The illustrated form of the sensor disks connected to the crankshaft and camshaft is by way of example and can be replaced by other selectable forms.

The two sensor disks 10, 14 are sensed by sensors 18, 19, for example inductive sensors or Hall sensors and the signals produced in the sensors as the angle marks pass by are either prepared immediately and fed to a control device 20 or only prepared in a suitable way in the control device, square-wave signals being formed, for example, whose rising edges correspond to the start of an angle mark and whose falling edges correspond to the end of an angle mark. These signals and the timing sequences of the individual pulses are further processed in the control device 20.

The control device 20 receives, via various inputs, further input variables which are required for the open-loop or closed-loop control of the internal combustion engine and which are measured by various sensors. Possible examples of such sensors are: a temperature sensor 21 which measures the engine temperature, a throttle valve sensor 22 which records the position of the throttle valve and a pressure sensor 23 which measures the pressure in the intake pipe or the pressure in a cylinder of the internal combustion engine. Furthermore, an "ignition-on" signal is fed via the input 24, which signal is supplied by the terminal K115 of the ignition lock when the ignition switch 25 is closed.

On the output side, the control device which comprises computing and storage means (not illustrated) and a permanent memory designated by 30 makes available signals for the ignition and injection for corresponding components (not designated in greater detail) of the internal combustion engine. These signals are output via the outputs 26 and 27 of the control device 20.

Depending on requirements, further sensors can be used whose signals are fed to the control device, the control device 20 can also output further signals required for controlling the internal combustion engine. It is also not necessary for all the sensors illustrated to be present.

The voltage supply of the control device 20 is provided in a customary way with the aid of a battery 28 which is connected to the control device 20 via a switch 29 during the operation of the internal combustion engine and during a run-on phase after the engine is switched off.

The position of the two shafts 11, 15 during the operation of the internal combustion engine can be detected at any time with the device described in FIG. 1. Since the assignment between the crankshaft and camshaft is known, as is the assignment between the position of the camshaft and the position of the individual cylinders, a synchronization can take place after the reference mark is detected and the injection and the ignition can be open-loop or closed-loop controlled in a known manner after synchronization has taken place. Such a control of an internal combustion engine is described for example in DE-A 39 23 478 and is therefore not described in greater detail.

However, with the device described in FIG. 1 it is also possible to detect, according to the invention, the position of the engine during coasting during the so-called running-on phase. In this running-on phase which follows the customary normal operation, known for example from the abovementioned Offenlegungsschrift, of the internal combustion engine, another evaluation of the sensor output signals occurs, the last detected positions of the crankshaft and camshaft are stored in the permanent memory of the control device and are therefore immediately available when switching on occurs again. The precise procedure is described in DE-P 42 30 616.

Figure 2:
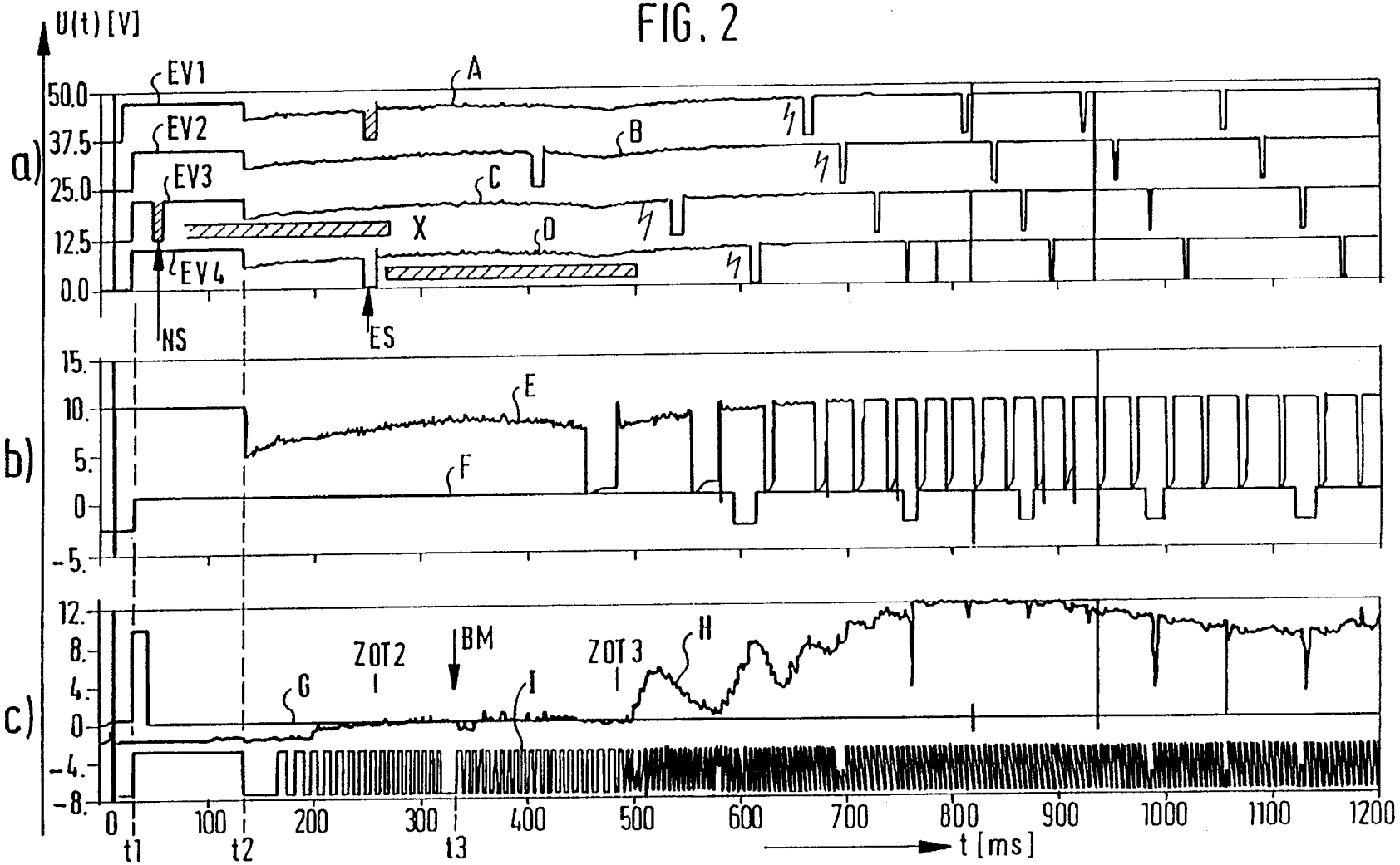

In FIG. 2, the signal profiles or voltage profiles U(t)[v] which are essential for comprehension of the invention and which were recorded during test runs or plotted against time t in milliseconds for a four-cylinder internal combustion engine. Here, FIG. 2*a* shows the drive signals A, B, C and D output by the control device for the injection valves of the cylinders 1 to 4, the injections being characterized by the minimum values. The ignitions which take place in the individual cylinders are symbolized with an arrow, and the region X designates the opened cylinder inlet valves.

In FIG. 2*b*, the upper signal E indicates the profile of the ignition signals and the lower signal F is the output signal of the camshaft sensor or of the phase sensor, in this case the minimum value occurs every 720° CA.

In FIG. 2*c*, the drive signal G for the electric fuel pump relay and the speed-of-revolution signal H and the output signal I of the crankshaft sensor are plotted.

At the time t=0, the start of the internal combustion engine is initiated by means of the ignition lock 25. At the time t1, voltage is applied to the individual systems or sensors by the control device 20, and the electric fuel pump relay is activated so that the fuel pump begins to feed fuel. Since the control device 20 already knows the precise angle position of the crankshaft or camshaft at this time, it can begin immediately with the calculation of the times which are essential for the injection.

At the time t2, the starter is engaged and a notch occurs at the signals A to E as a result of the large current drain. Starting from the time t2 the engine begins to turn, the crankshaft sensor outputs speed-of-revolution-dependent pulses and at the time t3 the reference mark is detected; later, at a higher speed of revolution, the occurrence of the speed-of-revolution signals with the resolution selected in FIG. 2 can no longer be detected.

After the first minimum value of the phase signal is generated, the regular synchronization can take place and normal SEFI takes place.

In the example illustrated in FIG. 2 the injection valve EV3 is firstly open and the control device can trigger a first correctly phased injection even before the engine begins to turn. This first injection is designated by NS and is also referred to as zero injection since the speed of revolution is still zero and it takes place into an open inlet valve. The zero injection can be triggered for example after the control device reset and it can be triggered with the first speed-of-revolution signal or with the engagement of the starter. Here, the engagement of the starter can be detected by means of the voltage notch which is caused by it or by means of the starter terminal K150 itself.

The precondition for this zero injection is that the necessary fuel pressure is already present in the fuel distributor. If the internal combustion engine has not been switched off for too long or is still in the run-on phase, the necessary fuel pressure is usually still present so that under these conditions a zero injection can be output.

Starting from the time t2, the engine begins to turn and as a result other injection valves are opened. In the example according to FIG. 2, this is the injection valve EV4. Even before the synchronization of the internal combustion engine has taken place, further injections, which are designated as first injections ES, are triggered by the control device. These first injections ES take place at EV4 into the open inlet valve and at EV1 they are timed before the opening of the inlet valve. Thus, it is ensured that the first cylinder which can be fired after the synchronization already contains ignitable mixture and here the engine is already starting to turn under its own power, which signifies a shortening of the starting time.

After synchronization has taken place, the control device switches to normal injection, for example to the known SEFI injection. At the same time, the necessary ignitions are then triggered by the control device so that the internal combustion engine has reached its normal operating state.

The transition from the starting injection to the normal injection is designed such that there is no absence of an injection, or double injection, into the individual cylinders. During the calculation of the injection quantity the control device can take into account temperature-dependent parameters.

If the engine had been switched off for a relatively long time so that the fuel pressure has dropped severely, no fuel is injected at the zero injection but the two first injections can take place since a fuel pressure which is adequate for injections has already been built up by the fuel pump at this time. In this case, a considerable improvement in the running up of the speed of revolution is also obtained with the method according to the invention.

In the most unfavorable case, the positions of the crankshaft and camshaft stored after running on has ended does not correspond to the actual positions so that the wrong injection valves are driven in the starting phase before synchronization and this leads to a degradation of the running up of the speed of revolution in comparison with the correct driving and the running up of the speed of revolution then corresponds to the running up of the speed of revolution to be achieved in systems without injection before the synchronization.

Instead of a system in which the positions of the crankshaft and camshaft are detected during a running-on phase and the position is stored when the engine is stationary, a more complex absolute sensor system can also be used which detects the absolute position of the crankshaft and camshaft immediately after switching on or after the control device reset. With such a system, zero injections and/or first injections can also be realized since the necessary information can be made available to the control device even before the engine begins to turn so that it can start immediately with the necessary calculations and can make the necessary drive signals available.

Such an absolute sensor system can have for example a plurality of code tracks which are sensed by a sensor in each case. When switching on occurs, the exact position of the crankshaft and camshaft can then be determined, before one of these shafts begins to turn, from the signals in the control device supplied by the sensors.

We claim:

1. A device for controlling a fuel injection in an internal combustion engine, comprising means for determining an angle position of at least one of a crankshaft and a camshaft; and a control device including means for evaluating the determined angle position up to a stationary state during a running-on phase after an ignition of an internal combustion engine is switched off, means for storing the evaluated position in the stationary state, means using the stored position directly after the internal combustion engine is switched on so as to form control signals for a first injection into an inlet valve at least as the internal combustion engine starts to turn, said means for using triggering further injections into inlet valves of other cylinders after a start of turning, but still before synchronization has taken place, and means for providing a transition to a customary cylinder-specific injection after the synchronization.

2. A device as defined in claim 1, wherein said means for using is formed so as to form the control signals for a first injection into an open inlet valve.

3. A device as defined in claim 1, wherein said means for using is formed so as to form the control signals for a first injection before closing of an inlet valve.

4. A device as defined in claim 1, wherein said means for using is formed so as to provide a first injection into the inlet valve before the engine starts to turn.

5. A device as defined in claim 1, wherein said means for using is formed so as to provide the further injections into open inlet valves of other cylinders.

6. A device as defined in claim 1, wherein said means for using is formed so as to provide further injections before closing of inlet valves of other cylinders.

7. A device as defined in claim 1, wherein said determining means include sensors which sense at least one of a crankshaft and a camshaft and produce sensor signals, said control device receiving said signals and also receiving an ignition-on signal.

8. A device as defined in claim 7, wherein said sensors include a sensor disk associated with at least one of said crankshaft and said camshaft provided with a reference mark which is detected by the evaluation of the sensor signals in said control device so that the synchronization is triggered after said reference mark is detected by said control device.

* * * * *